United States Patent [19]

Benelli

[11] Patent Number: 4,619,183

[45] Date of Patent: Oct. 28, 1986

[54] DEVICE FOR CAUSING A FIREARM TO FIRE IN CONTROLLED BURSTS

[75] Inventor: Paolo Benelli, Pesaro, Italy

[73] Assignee: Benelli Armi S.p.A., Urbino, Italy

[21] Appl. No.: 602,216

[22] Filed: Apr. 19, 1984

[30] Foreign Application Priority Data

May 9, 1983 [IT] Italy ..... 44020 A/83

[51] Int. Cl.[4] ..... F41D 11/10

[52] U.S. Cl. ..... 89/129.02

[58] Field of Search ..... 89/129.02

[56] References Cited

U.S. PATENT DOCUMENTS 3,803,976 4/1974 Visser ..... 89/129.02

FOREIGN PATENT DOCUMENTS 677817 7/1939 Fed. Rep. of Germany ... 89/129.02

*Primary Examiner*—Stephen C. Bentley

*Attorney, Agent, or Firm*—Amster, Rothstein & Ebenstein

[57] ABSTRACT

A burst fire device makes it possible, by means of an appropriate fire selector, to fire either a single shot or controlled bursts comprising three or more shots every time the trigger of the firearm is pulled. The mechanism includes a ratchet wheel (3) pivoted on the receiver (4) of the firearm and having a plurality of trip teeth (24), (25), (26) corresponding to the number of shots to be fired with a burst. The whole movement of the ratchet wheel (3), and as a result the operation of the mechanism, is based on the direct contact of the trigger (1) against the ratchet wheel (3), which contact is provided exclusively by the pressure exerted by the operator's finger.

2 Claims, 4 Drawing Figures

DEVICE FOR CAUSING A FIREARM TO FIRE IN CONTROLLED BURSTS

The present invention relates to apparatus including a trip mechanism for causing a firearm to fire in controlled bursts.

Presently used controlled burst devices including trip mechanisms are very limited in number and a few firearms have this particular fire system.

In most cases these trip mechanisms consist of complex lever systems which are difficult to assemble and set up, require particular cleaning and servicing operations for a correct operation of the firearm and make the firearm very complex and expensive.

It is the object of the present invention to obviate all these difficulties and provide a simple controlled burst fire device which consists of very few elements, operates in a fully original manner, has no difficulties concerning assembly and set up, does not require frequent servicing, is not cumbersome and is easily fitted to any type or arm.

A controlled burst fire device for a firearm according to the invention comprises a ratchet wheel pivotally connected to the receiver of the firearm which includes a plurality of trip teeth corresponding to the number of shots to be fired by a single burst and a plurality of lugs equal in number to the number of trip teeth. The ratchet wheel is urged towards a rest position when the firearm trigger is in its rest, non-firing position. The trigger of the firearm has a trip tooth adapted to engage the trip teeth of the ratchet wheel in a firing position of the trigger and stops pivoting of the ratchet wheel when the trigger is in its firing position. An arm is pivotally connected to the bolt and is resiliently biased into engagement with the lugs of the ratchet wheel as the bolt of the firearm moves towards a rest position back from its firing position to cause release of the ratchet wheel by the trip tooth of the trigger and rotation of the ratchet wheel until the next ratchet wheel trip tooth is engaged by the trigger trip tooth. The trigger is pivoted on a pin and a rocking arm is pivotally connected to the trigger resiliently biased into engagement with the pin. The firearm includes a bolt stopping element which is resiliently urged towards its rest position in which it engages the bolt and prevents the bolt from moving to its firing position when moved from its rest position, the bolt stopping element allowing the bolt to move toward its firing position. A trip tooth is provided on the bolt stopping element and is engageable by the tooth of the rocking arm when the rocking arm engages the pin to hold the bolt stopping element out of its rest position and out of engagement with the bolt. One of the trip teeth on the ratchet wheel is releasably engaged by the trip tooth of the trigger and permits the trigger to pivot to a position causing the rocking arm to release the bolt stopping element and permit it to move back into its rest position and in engagement with the bolt after a burst has been fired.

The ratchet wheel carries out a predetermined rotation under the action of the bolt at each shot fired and the position it takes every time is assured only by the trigger resting on it under the exclusive action of the finger pressure actuating it.

At the same time, when the ratchet wheel changes its position under the action of the bolt of the firearm, its movement is so rapid that the shooter does not feel it at all on his finger actuating the trigger.

Once the bolt stopping element has been released, the burst is discontinued and, in order to continue to fire, it is required that the shooter releases the trigger and depresses it again.

During this movement and before the trigger is depressed again, the ratchet wheel released from the contact of the trigger, returns to its rest position under the action of the spring which causes it to rotate in a direction opposite that imparted it by the bolt and is ready immediately to repeat the working cycle.

It is finally possible, by means of an appropriate fire selector, to fire by means of the same trip mechanism also single shots by changing the intersection surface between the trigger and the bolt stopping element. Under this condition, in fact, every time the trigger is pulled, a shot goes off and releases the catch of the bolt before the trigger abuts the ratchet wheel. It is therefore apparent that in order to fire another shot, it is necessary to release and pull again the trigger thus creating the condition for semiautomatic fire.

The invention will be better understood from the following detailed description, given merely as an example and therefore not in a limiting sense, of an embodiment thereof as applied to a firearm with blow back locking firing with the bolt in an unlocked position, of which all parts are omitted which operate in a manner similar to that of firearms presently in use.

Figure 3:
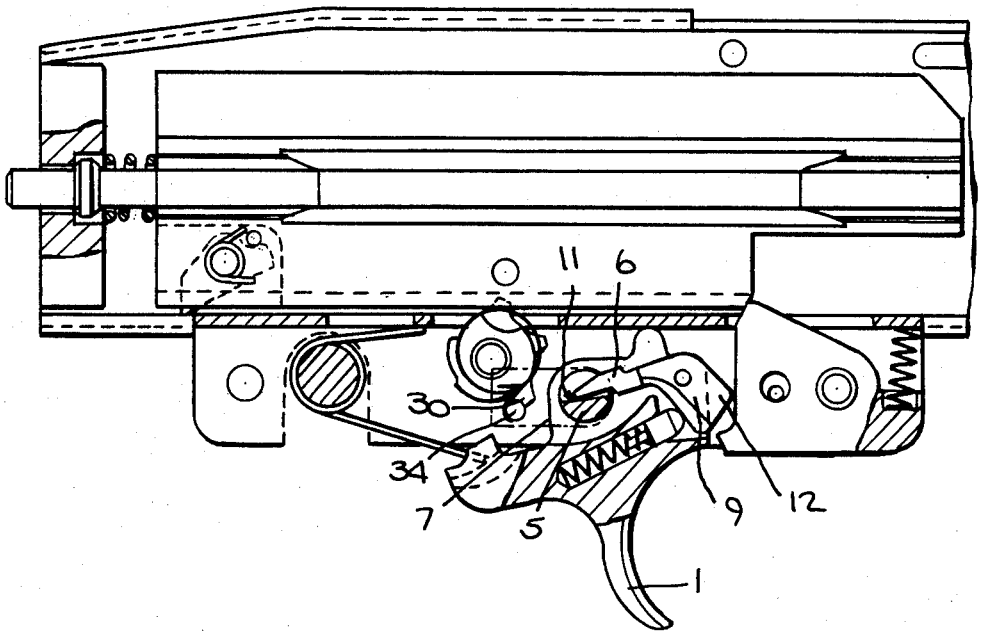
Figure 4:
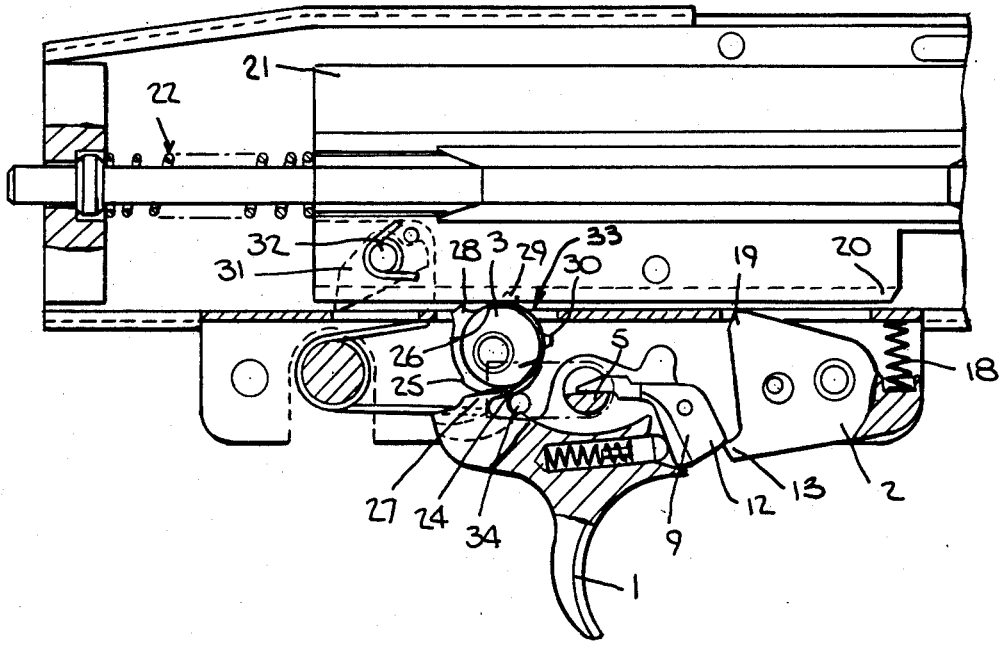

FIG. 3 shows the trip mechanism in the rest position, ready for firing, in the controlled burst operating condition of the firearm; and FIG. 4 shows the trip mechanism in the controlled burst operating condition of the firearm with the trigger which, depressed by the finger actuating it, is in abutment with the ratchet wheel, the bolt which has already fired a shot returning to its rest unlocked position and the bolt stopping element which, being still engaged with the trigger, leaves the bolt free for burst fire.

The trip mechanism according to the invention comprises essentially (FIG. 1) a trigger 1, a bolt stopping element 2 and a ratchet wheel 3.

The trigger 1 is pivoted to the receiver 4 of the arm by means of a pin 5 having a reduced diameter flat face portion 6. The pin can be rotated from outside the firearm by means of its extension 7.

Pivoted on the trigger 1 by means of the pin 8 is an arm 9 which biased by the spring 10, is maintained by means of its tongue 11 in abutment with the pivot 5 of the trigger 1.

The arm 9 has a trip tooth 12 adapted to engage a similar trip tooth 13 of the bolt stopping element 2 pivoted to the receiver 4 of the firearm by means of the pin 14.

The arm 9 is in addition provided with a protuberance 15 which, by coming in abutment with the receiver 4 of the firearm, determines the front rest or stop position of the trigger 1 biased by the spring 16 secured to the pin 17.

The bolt stopping element 2 has a spring 18 biasing it always upwards with its trip tooth 19 engaged with a similar catch 20 of the bolt 21 biased by the spring 22.

The ratchet wheel 3 pivoted on the receiver 4 of the firearm by means of the pin 23 has three trip teeth 24, 25, 26 adapted to engage a similar trip tooth 27 of the trigger and three lugs 28, 29, 30 adapted to engage an arm 31 pivoted on the bolt 21 by means of the pin 32.

The ratchet wheel 3 is provided with a torsion spring 33 which biases it in a clockwise direction into abutment with the lug 30 on the stop pin 34. The arm 31 is provided with a torsion spring 35 which biases it in a counterclockwise direction into engagement with the stop pin 36.

Figure 1:
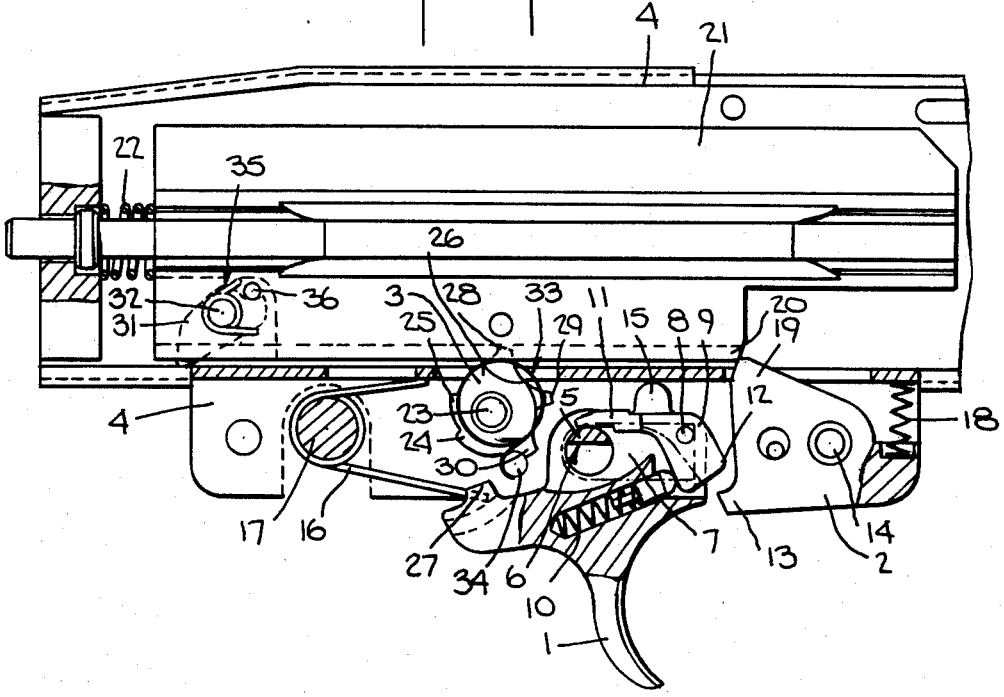
FIG. 1 shows the trip mechanism in a rest position, ready for firing, in the semiautomatic operating condition of the firearm.

In the position of FIG. 1 the firearm is ready for single shot firing; the bolt 21 is engaged in its rest, non-firing position by means of its catch 20 on the associated trip tooth 19 of the bolt stopping element 2, the trigger 1 is in rest position rotated forwardly on its pivot 5 in the stop position determined by the protuberance 15 of the arm 9 on the receiver 4 of the firearm, the ratchet wheel is free in its rest position determined by the abutment of the lug 30 against the pin 34 and the tongue 11 of the arm 9 is in abutment with the outer diameter of the pivot 5 of the trigger 1.

Figure 2:
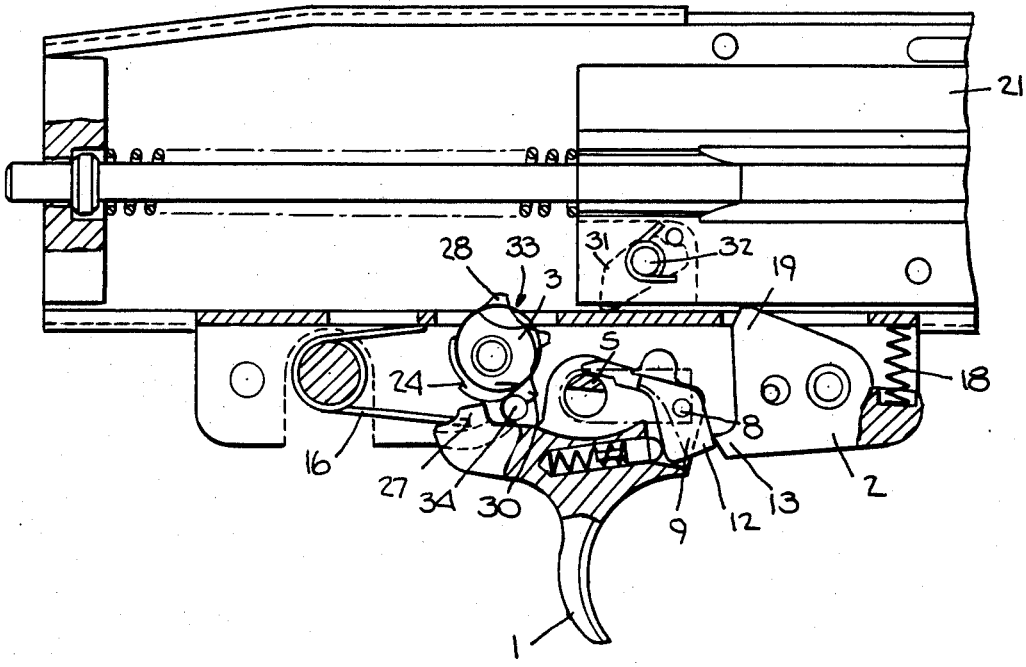
FIG. 2 shows the trip mechanism in the semiautomatic operating condition of the firearm with the trigger which has just fired a shot having rotated on its pivot under the action of finger pressure actuating it; the bolt stopping element being disengaged from the trigger which is at the end of its stroke in abutment with the ratchet wheel.

When the trigger 1 is depressed (FIG. 2), it rotates in clockwise direction on its pivot 5 and the trip tooth 12 of the arm 9 abuts the trip tooth 13 of the bolt stopping element 2 and lowers it until the trip tooth disengages from the associated catch 20 of the bolt 21 which under the bias of the spring 22 goes from the unlocked, rest position of FIG. 1 to the firing locking position of FIG. 2 and strikes the cartridge in the barrel.

During the rotation of the trigger 1, before it reaches the rear stop position determined by the abutment of the trip tooth 27 against the ratchet wheel 3 (FIG. 2), the arm 9 is disengaged by means of its trip tooth 12 from the associated trip tooth 13 of the bolt stopping element 2 which, not being pressed downwards any longer, is free, when the bolt returns to the rest unlocking position shown in FIG. 1, under the action of the spring 18, to stop the bolt 21 in its unlocking position and engages again its trip tooth 19 with the associated catch 20 of the bolt 21 thus preventing the a second shot from going off which will occur only if the trigger 1 is released and pressed again. Upon release of the trigger 1, it is pushed forward by the spring 16 and rotates on its pivot 5 in a counterclockwise direction until it returns to the position shown in FIG. 1 ready for a new shot inasmuch as the arm 9 rotates for an instant on its pivot 8 and permits its trip tooth 12 to go beyond the associated trip tooth 13 of the bolt stopping element 2 and to lock the bolt stopping element again.

During single shot fire, the ratchet wheel 3 does not take part at all in the operation of the trip mechanism but limits itself to carry out a rocking only when, the trigger 1 having been depressed, the bolt 21 returns from the position of FIG. 2 to the position of FIG. 1.

In this movement in fact the tongue 31 pivoted to the bolt 21 by means of the pin 32 strikes against the lug 28 of the ratchet wheel 3 and causes it to rotate until the trip tooth 27 of the trigger 1 hooks the trip tooth 24 of the ratchet wheel 3.

Immediately after, while the shooter releases and depresses again the trigger 1 to fire another shot, the ratchet wheel 3 returns, under the action of the torsion spring 33, in the rest position determined by the abutment of the lug 30 against the pin 34 before the trigger 1 is fully depressed again.

If it is instead desired to use the firearm for controlled burst firing, it is necessary to prearrange the firearm for this type of use.

To this end (FIG. 3) it is sufficient to rotate by 180° the fire selector of the firearm consisting of the extension 7 of the pin 5 on which the trigger 1 is pivoted.

In this manner in fact the tongue 11 of the arm 9 abuts the flat face 6 provided on the pin 5 and determines a longer extension of the trip tooth 12 of the arm 9 from the trigger 1.

It is apparent at this time that the firearm in the position of FIG. 3 is ready for controlled burst fire which, in the described case, is a three shot bursts inasmuch as three are the lugs and the trip teeth of the ratchet wheel 3.

By pulling the trigger 1, in fact, similarly to what happened for the single shot fire, the trigger (FIG. 4) rotates in clockwise direction on its pivot 5 and the trip tooth 12 of the arm 9 abuts the trip tooth 13 of the bolt stopping element 2 and lowers it until the trip tooth 19 disengages from the associated catch 20 of the bolt 21 which, pushed by the spring 22, goes from the position of FIG. 3 to the position of FIG. 4 and strikes the cartridge in the barrel.

At the same time when, in the first step, the trigger 1 reaches the rear stop position determined (FIG. 4) by the abutment of the trip tooth 27 against the ratchet wheel 3, the arm 9 does not succeed in disengaging by means of its trip tooth 12 from the associated trip tooth 13 of the bolt stopping element 2 which remains therefore still lowered in the position shown in FIG. 4.

At this time when the bolt 21, after the first shot has been fired, returns from the locking (firing) position towards the unlocking (rest) position, pushed by the pressure of the gases given off by the combustion of the powder charge, the tongue 31 pivoted on it by means of the pin 32, strikes against the lug 28 of the ratchet wheel and causes it to rotate until the trip tooth 27 of the trigger 1 which is being continuously depressed by the finger of the shooter, hooks the trip tooth 24 of the ratchet wheel 3 which condition is shown in FIG. 4.

Thereafter the bolt 21 which has reached the unlocking position, the bolt stopping device 2 being still lowered as seen above, will return again to the locking position and fire automatically the second shot.

While the bolt 21 is returning again to the unlocking position, the tongue 31 pivoted to it by means of the pin 32, strikes against the lug 29 of the ratchet wheel 3 and causes it to rotate until the trip tooth 25 of the ratchet wheel 3 hooks the trip tooth 27 of the trigger 1 in place of the trip tooth 24 of the same ratchet wheel.

When the bolt has again reached the unlocking position, the bolt stopping element 2 being still held lowered by the trigger 1 as stated above, the bolt 21 will return again to the locking position, biased by the spring 22, and will fire automatically the third shot.

While the bolt 21 returns again to the unlocking position, the tongue 31 pivoted on it by means of the pin 32 strikes the lug 30 of the ratchet wheel 3 and causes it to rotate until the trip tooth 26 of the ratchet wheel 3 hooks the trip tooth 27 of the trigger 1 in place of the trip tooth 25 of the same ratchet wheel.

At this time, while the bolt 21 still continues its unlocking movement, the trigger 1, always depressed by the finger of the shooter, rotates again on its pivot 5 inasmuch as its trip tooth 27 is free to move beyond the trip tooth 26 of the ratchet wheel 3.

This further rotation causes the arm 9, like in the single shot fire (FIG. 2), to disengage its trip tooth 12 from the associated trip tooth 13 of the bolt stopping element 2 which, being no longer depressed downwards, is free, under the action of the spring 18, to stop the bolt 21 in its unlocked position once the bolt has completed its backward unlocking movement.

The controlled burst fire is interrupted, after three shots have been fired, with the bolt 21 is stopped in the unlocking position (FIG. 3) determined by the engagement of its catch 20 with the associated trip tooth 19 of the bolt stopping element.

At this time, as soon as the shooter stops holding the finger depressed on the trigger 1, the trip tooth 27 does not engage any longer the ratchet wheel 3 which returns, under the action of the torsion spring 33 to its rest position determined (FIG. 3) by the abutment of its lug 30 against the pin 34.

In this manner the firearm is prearranged for controlled burst fire of three further shots as soon as the shot depresses again the trigger 1.

The system therefore provides a trip mechanism which allows firing, with the same firearm, both a single shot and a controlled burst with extreme easiness and safety of use.

The invention can be carried out in other specific embodiments, differring from that which has been described, without departing from the spirit and the essential technical features of the invention.

In particular, similar trip mechanisms fall within the scope of the present invention which are capable of controlled burst firing of about three shots inasmuch as it is sufficient to increase or decrease the number of trip teeth on the ratchet wheel 3. The provision in similar mechanisms of continuous burst fire falls also within the scope of the invention inasmuch as it is sufficient to increase the number of positions of the burst selector which is controllable from outside the firearm and consists of the extension 7 of the pivot on which the trigger 1 is pivoted, and to provide two different flat faces on the pin 5 instead of the single flat face 6, thus varying the extension of the trip 12 of the arm 9 from the trigger 1 according to the requirements of the single shot, controlled burst and continuous burst.

In general, while but one embodiment of the invention has been described and illustrated, it is obvious that a number of changes and modifications can be made without departing from the scope of the invention.

I claim:

1. In a firearm including a receiver, a bolt, means resiliently biasing the bolt towards a firing position, a bolt stopping element which releasably engages the bolt in a rest position thereof and prevents the bolt from moving to its firing position, means resiliently biasing the bolt stopping element into releasable engagement with the bolt, a trigger pivotally connected to the receiver for moving the bolt stopping element out of engagement with the bolt to release the bolt, and means resiliently biasing the trigger toward a rest, non-firing position, the improvement comprising apparatus causing the firearm to fire in controlled bursts, said apparatus comprising a ratchet wheel pivotally connected to the receiver, means resiliently urging the ratchet wheel towards a rest position when the trigger is in its rest position, the ratchet wheel comprising a plurality of trip teeth corresponding to the number of shots to be fired by a single burst and a plurality of lugs equal in number to the number of trip teeth, the trigger having a trip tooth for releasably engaging the trip teeth of the ratchet wheel in a pivoted, firing position of the trigger to stop pivoting of the ratchet wheel, an arm pivotally connected to the bolt, means resiliently biasing the arm into engagement with a lug on the ratchet wheel as the bolt moves towards its rest position from its firing position to cause release of the ratchet wheel by a trip tooth of the trigger and rotation of the ratchet wheel until the next ratchet wheel trip tooth is engaged by the trigger trip tooth, the trigger being pivoted on a pin, a rocking arm pivotally connected to the trigger, means resiliently biasing the rocking arm into engagement with the pin on which the trigger is pivoted, the rocking arm having a trip tooth, the bolt stopping element having a trip tooth releasably engageable by the trip tooth of the rocking arm when the rocking arm engages the pin to hold the bolt stopping element out of engagement with the bolt, one of the trip teeth on the ratchet wheel being releasably engaged by the trip tooth of the trigger and permitting the trigger to pivot to a position causing the rocking arm to release the bolt stopping element and permit it to move into engagement with the bolt, said one trip tooth of the ratchet wheel defining the end of the burst.

2. In the firearm according to claim 1, the improvement further comprising the pin on which the trigger is pivoted being cylindrical and having a reduced diameter portion on a part thereof disposed to be selectively contacted by the rocking arm, a control member connected to the pin for moving the pin from a position in which the pin is contacted by the rocking arm on a cylindrical surface thereof to a position in which the pin contacts the rocking arm on its reduced diameter portion and vice versa, the rocking arm when contacting the reduced diameter portion of the pin permitting the trigger to pivot to said position causing the rocking arm to release the bolt, the control member and the pin operating as a fire selector for positioning the rocking arm either for burst fire or single shot fire.

* * * * *